US006237899B1

(12) United States Patent
Offir et al.

(10) Patent No.: US 6,237,899 B1
(45) Date of Patent: May 29, 2001

(54) HUMIDIFIER WITH WICK CHANGE INDICATOR

(75) Inventors: Yigal Offir; Neville R. Glenn, both of Milford; Paul Powers, Southboro; Robert S. VannRox, Milford, all of MA (US)

(73) Assignee: Holmes Products Corp., Milford, MA (US)

( * ) Notice: Subject to any disclaimer, the term of this patent is extended or adjusted under 35 U.S.C. 154(b) by 0 days.

(21) Appl. No.: 09/227,382

(22) Filed: Jan. 8, 1999

Related U.S. Application Data

(60) Provisional application No. 60/072,378, filed on Jan. 9, 1998.

(51) Int. Cl.[7] ..... B01F 3/04

(52) U.S. Cl. ..... 261/107; 261/DIG. 65; 73/29.02

(58) Field of Search ..... 261/104, 107, 261/DIG. 4, DIG. 34, DIG. 65; 73/29.02, 29.04, 335.07, 335.02, 335.08, 335.11, 335.12, 335.13, 335.14; 116/271; 96/421

(56) References Cited

U.S. PATENT DOCUMENTS

| | | | | |
|---|---|---|---|---|
| 1,970,301 | | 8/1934 | Frankel . | |
| 2,059,846 | | 11/1936 | Bulger . | |
| 2,114,105 | * | 4/1938 | Gerber | 96/421 |
| 2,411,041 | * | 11/1946 | Kahn | 73/335.07 |
| 3,425,388 | * | 2/1969 | West | 73/335.07 |
| 4,150,571 | | 4/1979 | Hayes et al. . | |
| 4,210,278 | | 7/1980 | Obler . | |
| 4,687,050 | | 8/1987 | Podlipnik . | |
| 5,285,960 | | 2/1994 | Zografos . | |
| 5,309,726 | | 5/1994 | Asbridge . | |
| 5,364,024 | | 11/1994 | Lin . | |
| 5,800,741 | | 9/1998 | Glenn et al. . | |
| 5,971,205 | * | 10/1999 | Michaels et al. | 221/135 |

* cited by examiner

*Primary Examiner*—David A. Simmons
*Assistant Examiner*—Robert A. Hopkins
(74) *Attorney, Agent, or Firm*—Hoffman & Baron, LLP; Francis E. Marino

(57) ABSTRACT

A humidifier includes a housing, a wick, a fan, and a wick change indicator. The housing has a upper and bottom portions. The bottom portion is formed with an air inlet and a reservoir. The reservoir holds water while supporting the wick. The wick is seated in the reservoir so that it is partially submerged in the water. The upper portion is formed with an air outlet with the fan mounted therein generally above the top of the wick. The wick change indicator generally includes at least one hygrometer and a display. At least one hygrometer is positioned within the airflow for measuring the exit-relative humidity of the airflow. The display is coupled to the hygrometer for indicating when the wick requires replacement based upon the measured exit-relative humidity reaching a predetermined value.

28 Claims, 21 Drawing Sheets

HUMIDIFIER WITH WICK CHANGE INDICATOR

This application claims the benefit of U.S. Provisional Application No. 60/072,378 filed Jan. 9, 1998.

BACKGROUND OF THE INVENTION

1. Field of the Invention

The present invention relates to an evaporative humidifier having a wick change indicator. More particularly, the present invention relates to a wick change indicator that monitors the performance of the wick to assess whether the wick requires replacement.

2. Description of the Prior Art

Humidifiers are useful in raising the humidity of air inside homes, particularly during periods of dry weather during the winter and heat inside a home causes the relative humidity within the home to be lowered to an uncomfortable level. Under these circumstances, it is beneficial to introduce moisture into the air. Several types of humidifiers for increasing humidity in a room are well known in the art, and include steam-type, ultrasonic, warm-air and evaporative humidifiers.

Certain humidifiers, and in particular the evaporative type, generally include a housing having an inlet, an outlet, and a reservoir for holding water, a water absorbing material seated partially submerged in the water of the reservoir, and a fan that is connected to the housing for creating an airflow. The water absorbing material is generally known as a wick in the art and is adapted to draw water in the upper non-emersed part by capillary action. The airflow created by the fan is directed to pass through the upper non-emersed portion of the wick to humidify the air in the room.

A problem associated with humidifiers that utilize wicks is that they tend to accumulate minerals from the water which blocks the capillary action of the wick. Accordingly, the performance of the wick degrades over time requiring replacement.

It is difficult to determine when a wick requires replacement by physical inspection or by monitoring the period of actual use. This is because both of these methods do not assess the actual performance of the wick. The wick will change color as a result of the absorption of various minerals over a period of a time. Since the minerals that exist in public water supplies vary from one municipality to another, practical replacement guidelines based only on a physical inspection and monitoring the length of use are not practical.

Commonly assigned U.S. Pat. No. 5,800,741 to Glenn et al. discloses an evaporative humidifier having a wick filter with color change indicator. The wick change indicator disclosed therein was premised upon a color change indicator that would change color after a period of use. As noted in the specification at Column 9, Lines 45–53, although the life of the wick filter is estimated to be approximately 6 weeks, the water supply can have an adverse effect on the color change indicator disclosed therein.

OBJECTS AND SUMMARY OF THE INVENTION

It is an object of the present invention to provide a humidifier with a wick change indicator.

It is a further object of the present invention to provide a wick change indicator that monitors the performance of the wick to assess whether the wick requires replacement.

It is another object of the present invention to provide a wick change indicator wherein the performance of the wick change indicator is not affected by the mineral content in the water supply.

It is yet another object of the present invention to provide a wick change indicator that is inexpensive and easy to manufacture.

In accordance with one form of the present invention, a humidifier includes a housing having an air inlet, an air outlet, and a reservoir for holding water. The reservoir supports a wick which is seated therein. A fan is provided within the housing for creating an airflow. The airflow enters the air inlet, passes through the wick for adding moisture to the air and exits through the air outlet. The exiting air has an exit-relative humidity associated therewith. A wick change indicator is also provided. The wick change indicator includes a hygrometer positioned within the airflow for measuring the exit-relative humidity of the airflow and a display coupled to the hygrometer for indicating when the wick requires replacement based upon the measured exit-relative humidity reaching a predetermined value. Preferably the predetermined value is approximately 87 percent.

In a preferred embodiment of the present invention, the hygrometer has a humidity sensitive element which is coupled to an indicating needle providing a visual display that the wick requires replacement. Preferably the humidity sensitive element is a metallic coil. The hygrometer may include a support plate with the display formed thereon. The display includes markings such that the needle is positioned with respect to the markings to provide an indication that the wick needs replacement. In an alternative embodiment the metallic coil has a tapered width that decreases from a central end to an external end of the coil for increased accuracy.

In another embodiment of the present invention, the hygrometer is provided as a chemically impregnated label. The label changes color as a function of humidity. The label has a first region that is light in color and darkens when the exit-relative humidity of the airflow reaches a first predetermined value. The label also has a second region that is light in color and darkens when the exit-relative humidity of the airflow reaches a second predetermined value. Either the first region or the second region define a set of indicia to form the display. Preferably the first predetermined value is approximately 87 percent and the second predetermined value is approximately 60 percent.

In yet another embodiment of the present invention, the hygrometer is provided in the form of an electrical-type hygrometer, e.g. a resistive or capacitive element whose value varies as a function of sensed humidity. The display is a liquid crystal type which is mounted to the housing and is calibrated to indicate that the wick requires replacement when the exit-relative humidity of the airflow falls below a predetermined humidity.

In still a further embodiment of the present invention, the wick change indicator includes a second hygrometer that measures the ambient-relative humidity. The wick change indicator has a means for comparing the exit-relative humidity with the ambient-relative humidity for indicating when the wick requires replacement.

The present invention is also directed to a method of monitoring the performance of a wick in a humidifier to determine replacement, includes the steps of:

(a) measuring the exit-relative humidity of the airflow as the airflow exits through the outlet of the housing; and (b) providing an indication that the wick requires replacement when the exit-relative humidity falls below a predetermined value.

In the method, the predetermined value is preferably approximately 87 percent.

A preferred form of the humidifier having a wick change indicator of the present invention, as well as other embodiments, objects, features and advantages of this invention will apparent from the following detailed description of illustrative embodiments thereof, which is to be read in connection with the accompanying drawings.

DETAILED DESCRIPTION OF THE PREFERRED EMBODIMENTS

The present invention is directed to a humidifier that has a wick change indicator. The wick change indicator monitors the performance of the wick to assess whether the wick requires replacement. The general features and operation of humidifiers that include a wick are known to those skilled in the art. Examples of humidifiers are described in U.S. Pat. No. 5,800,741 to Glenn et al. the disclosure of which is incorporated herein by reference. A brief summary of the operation of a humidifier having a wick change indicator is set forth below followed by a detailed discussion of the preferred embodiments of the wick change indicator.

Figure 1:
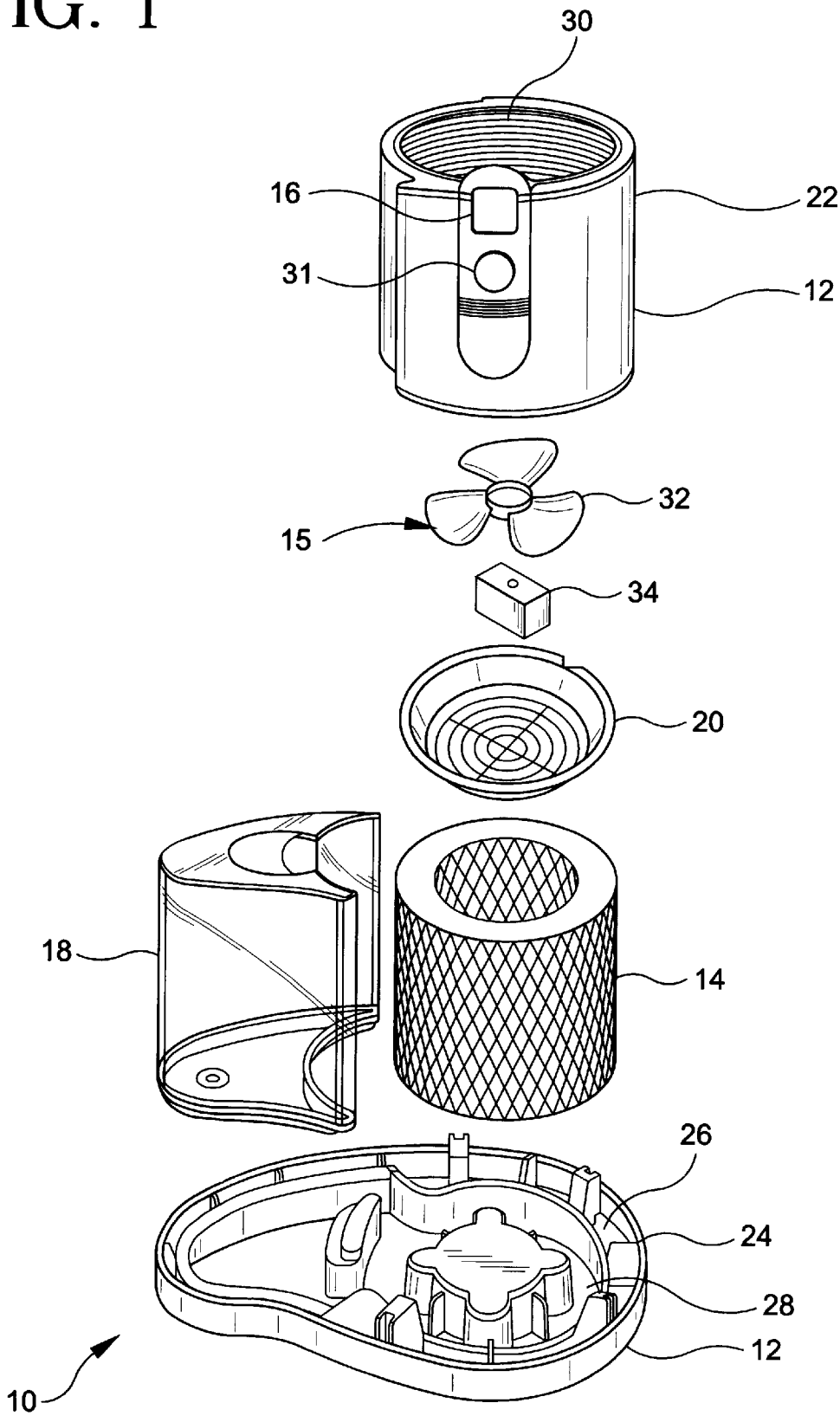
FIG. 1 is an exploded view of a preferred embodiment of the present invention.

Referring now to FIG. 1, a humidifier 10 in accordance with the present invention generally includes a housing 12, a wick 14, a fan 15, and a wick change indicator 16. The humidifier can also include a tank 18 and an air deflector 20.

The housing has an upper portion and bottom portions 22, 24. The bottom portion 24 is formed with an air inlet 26 and a reservoir 28. The reservoir 28 holds water while supporting the wick 14. The tank 18 is removably engageable with the bottom portion 24 and supplies the reservoir 28 with water. The wick 14 is seated in the reservoir 28 so that it is partially submerged in the water. The upper portion 22 is formed with an air outlet 30 and has the fan 15 mounted therein generally above the top of the wick 14. Generally, the upper portion 22 of the housing also supports a control 31 for regulating the fan 15 speed and thus the amount of moisture generated by the humidifier.

The wick 14 is fabricated from a material that absorbs fluids. Preferably the wick is made from expanded cotton/cellulose which has excellent capillary action soaking water in the reservoir up into the entire wick.

The fan 15 generates an airflow through the humidifier 10. Preferably the fan 15 includes a plurality of fan blades 32 that are connected to a motor 34 for generating the airflow. The fan pulls dry outside air up through the moistened wick to provide an exiting airflow carrying moisture therein.

The wick change indicator 16 generally includes at least one hygrometer and a display. The at least one hygrometer is positioned within the airflow for measuring the exit-relative humidity of the airflow. The display is coupled to the hygrometer for indicating when the wick 14 requires replacement based upon the measured exit-relative humidity reaching a predetermined value. Preferably the predetermined value is set at 87 percent.

In the operation of the humidifier 10, water from the tank 18 fills the reservoir 28 to a level so that the wick 14 is partially submerged. Water is drawn up into the non-immersed portion of the wick 14 by capillary action. As earlier discussed, the fan 15 generates an airflow that enters the humidifier 10 through the air inlet 26, passing through the wick 14 where it picks up moisture and exits the humidifier 10 through the air outlet 30. The wick change indicator 16 provides an indication that the wick requires replacement when the exit-relative humidity falls below a predetermined value.

Figure 2B:
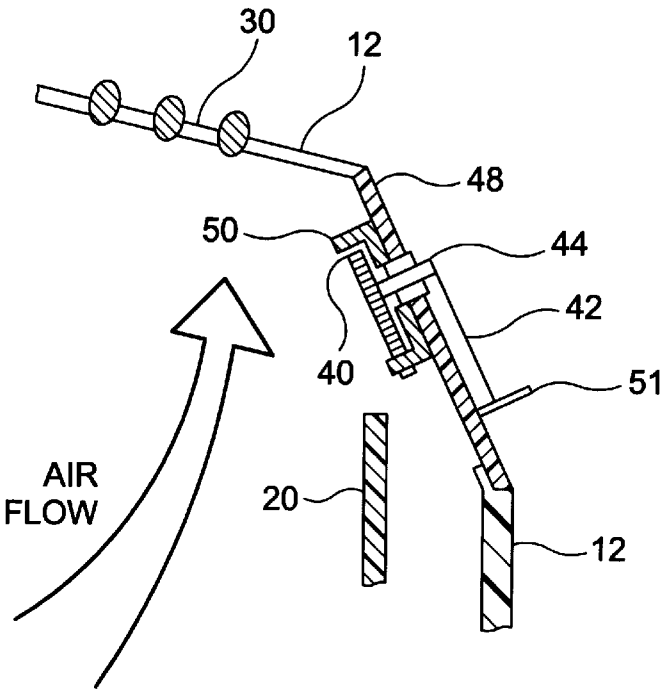
FIG. 2B is a cross-sectional view through the display of a preferred embodiment shown in FIG. 2A.
Figure 2A:
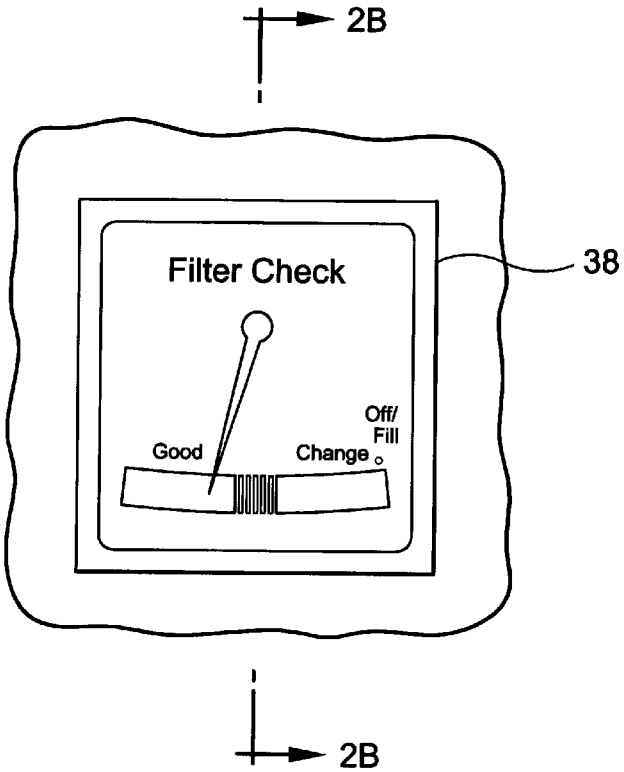
FIG. 2A is an elevational view of a display of a preferred embodiment of the present invention.
Figure 3:
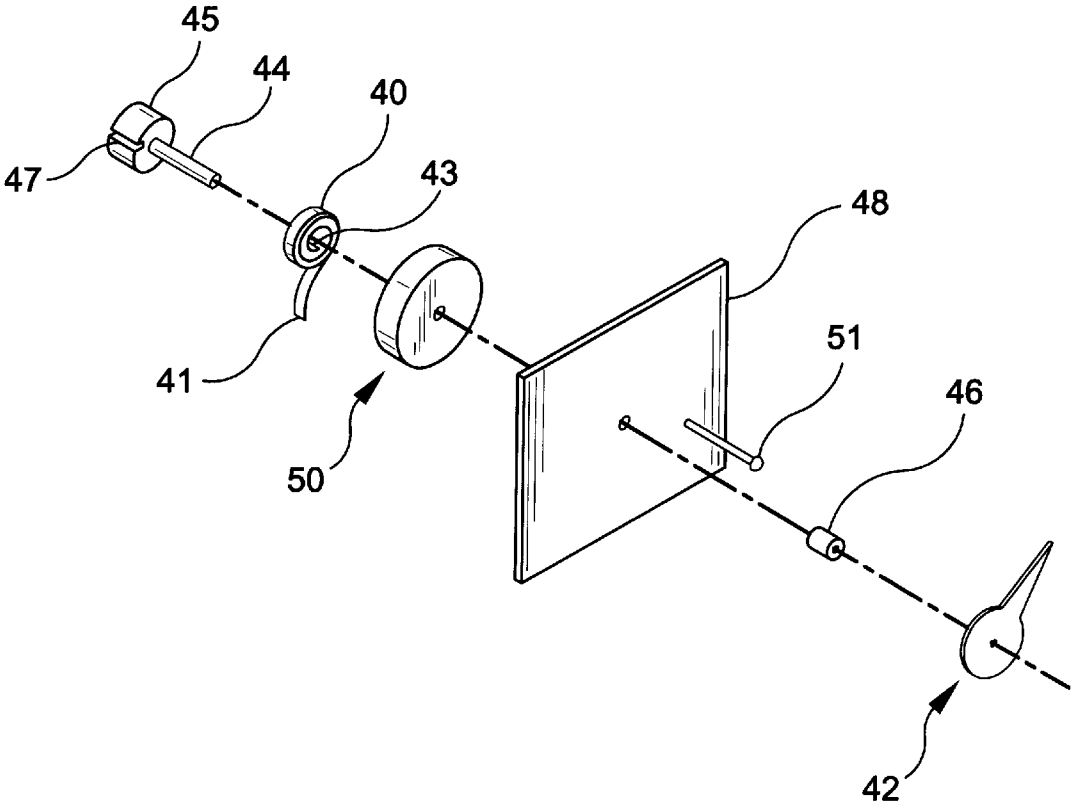
FIG. 3 is an exploded view of a preferred embodiment of the present invention shown in FIGS. 2A and 2B.

Referring now to FIGS. 2A, 2B and 3, a preferred embodiment of the wick change indicator 16 includes a mechanical hygrometer 36 and a display 38. The mechanical hygrometer 36 has a humidity sensitive element 40 and an indicating needle 42 coupled thereto for providing a visual display that the wick 14 requires replacement. Preferably the humidity sensitive element 40 is a metallic coil having a free end 41 and a central end 43. As shown in FIG. 3, the indicating needle 4 is coupled to one end of the humidity sensitive element 40 with a shaft 44 that extends through a bearing 46, which is supported by a support plate 48. The shaft 44 has a thickened portion 45 formed with a slot 47. The internal end 43 of the metallic coil is received by the slot 47 to form the connection between the coil and shaft 44. The support plate 48 can be a separate part that is configured to attach to the housing 12 or it can be integrally formed as part of the housing 12. As shown in FIG. 2B, the humidity sensitive element 40 is positioned within an interior portion of the humidifier 10 with the housing 12 and air deflector 20 being configured to ensure that the element 40 is exposed to the exiting airflow. The exiting airflow has previously been forced through the wick element to pick up moisture for release into a room. The humidity sensitive element 40 is responsive to an exit-relative humidity causing the associated indicating needle 42 to rotate and thus provide an indication of the wick performance. Where the humidity sensitive element 40 is a metallic coil, a holder 50 is preferably provided to restrain the free end 41 of the coil. The display 38 is formed on the support plate 48 and calibrated with markings based upon the exit-relative humidity to provide an indication that the wick needs replacement. As shown in FIG. 2A, the display 38 is calibrated to indicate the wick needs replacement when the exit-relative humidity falls below about 87 percent.

Since the hygrometer cannot differentiate between the humidifier being "off", poor wick performance, or an exhausted water supply, the user must make such a distinction. Operating instructions to check these three possibilities upon an indication of low humidity exiting the humidifier allow the user to determine the cause of poor performance. In order to aid the user, the display 38 is also provided with an "Off/Fill" indicator as shown in FIG. 2A for providing visual indication that the humidifier is either off or needs to be filled with water. This position is indicated when the exit-relative humidity or sensed humidity by the hygrometer is relatively low and below the threshold indicia for filter replacement. A stop pin 51 is provided at the "Off/Fill" position on the display 38 to ensure that the display 38 provides the "Off/Fill" indication even when the exit-relative humidity is very low.

The operation of the wick change indicator 16 illustrated in FIGS. 2A, 2B and 3 will now be described. When the humidifier 10 is operating with a good wick 14 and the reservoir 28 is filled with water, the exit-relative humidity of the airflow will be high, generally above the predetermined threshold for indicating a wick change, (e.g., greater than 87%) and the wick change indicator 16 will provide a visual indication that the wick 14 is "good" i.e., the indicating needle 42 of the hygrometer will be positioned in the region designated as "Good" on the display 38 as shown in FIG. 2A. As the performance of the wick 14 deteriorates with use, the exit-relative humidity of the humidifier 10 will also decrease. This will be evident to the user because the indicating needle 42 will move towards a position on the display 38 indicating that the wick 14 requires replacement. This position is designated as "Change" on the display 38. When the needle of the hygrometer points to the region "Change" on the display and unit is operating with water in the reservoir, it is time to replace the wick filter 14.

As earlier discussed, the display 38 also provides visual indication should the water level in the reservoir 28 be exhausted such that the exit-relative humidity is low or to indicate that the humidifier 10 is turned "off" and thus the exit-relative humidity would be equal to the ambient humidity. If the wick change indicator 16 is providing an indication that the unit is "off" or "fill", the user will know to check to ensure water is provided in the supply tank 18 and/or that unit has been turned on. Once the tank 18 is filled and the unit turned on, the needle of indicator 16 will move from the "Off/Fill" position to indicate the condition of the filter.

Figure 4:
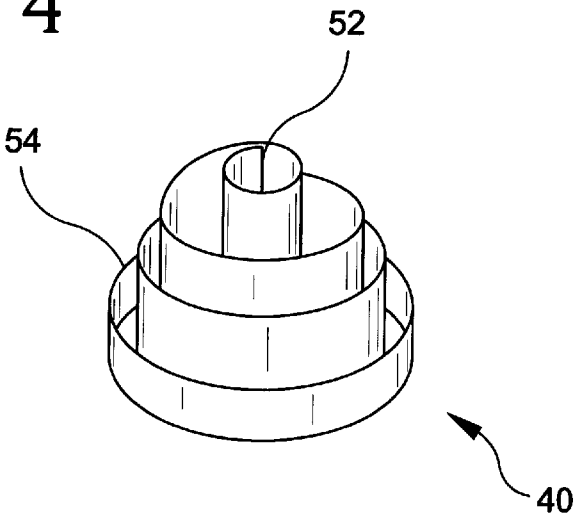
FIG. 4 is a elevational view of a tapered metallic coil that can be used in a preferred embodiment of the present invention shown in FIGS. 2A and 2B.

In an alternative embodiment, the humidity sensitive element 40 is a metallic coil, in which the coil width is tapered from a central end 52 to an external end 54 of the coil as shown in FIG. 4. The tapered width changes the rate of angular displacement of the indicating needle 42 allowing the region over which the display 38 is calibrated to be increased.

Figure 6:
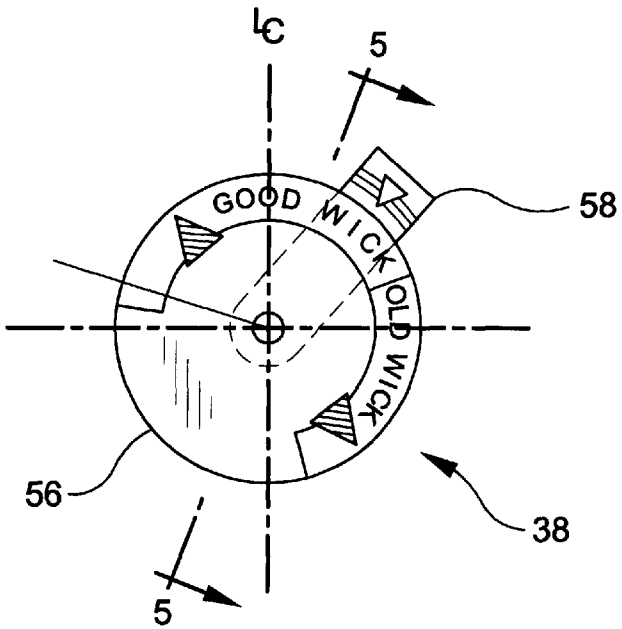
FIG. 6 is a elevational view of a display of an alternative embodiment of the present invention.
Figure 5:
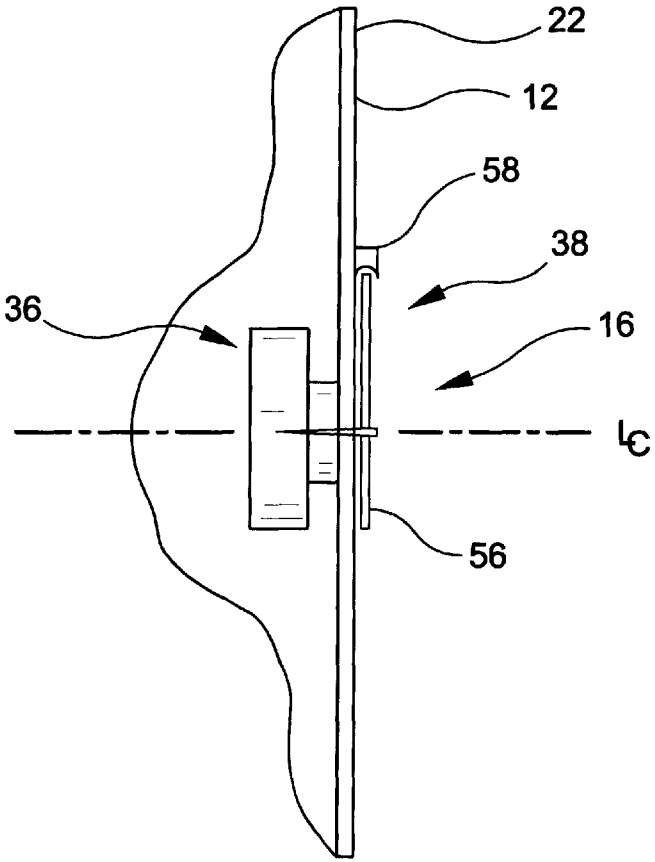
FIG. 5 is a partial cross-sectional view through the upper portion of the housing illustrating an alternative embodiment of the present invention.

Referring now to FIGS. 5 and 6, an alternative embodiment of the present invention also includes a mechanical hygrometer 36 as described above and a display 38. In this embodiment, the display 38 includes a dial 56 that is coupled to the humidity sensitive element 40 and an adjustable pointer 58. As shown in FIG. 6, the dial 56 includes markings for indicating when the wick is good or old and requires replacement. The dial 56 rotates with respect to the pointer 58. The pointer 58 is adjustable by the user to set an initial reading when a new wick is installed. As the performance of the wick deteriorates over time, the dial 56 will rotate based upon sensed exiting relative humidity to indicate when the wick needs replacement.

Figure 7:
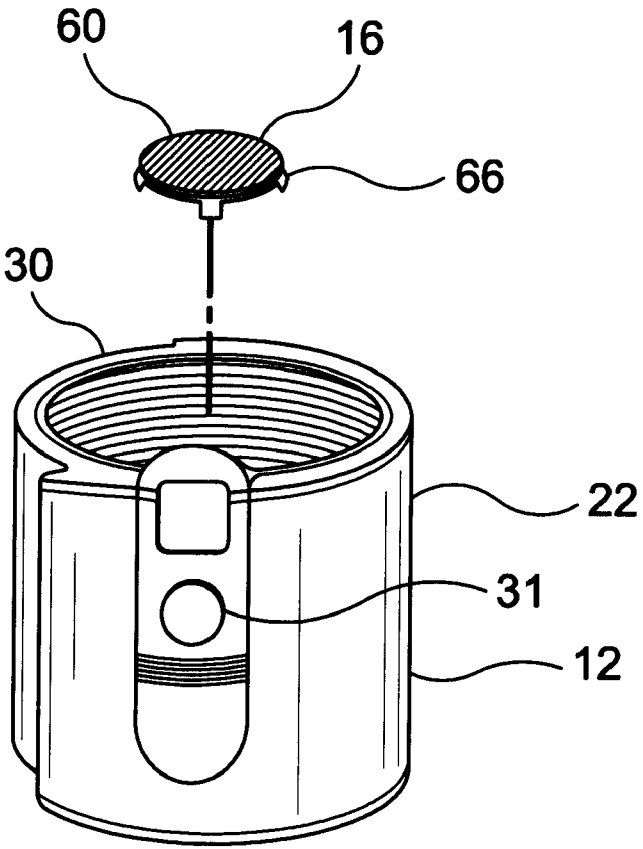
FIG. 7 is a partial exploded view of a preferred embodiment of the present invention that includes a label.
Figure 9:
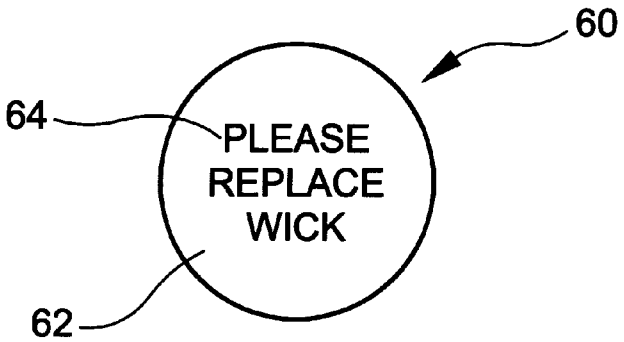
FIG. 9 is a plan view of the label shown in FIG. 7.
Figure 8:
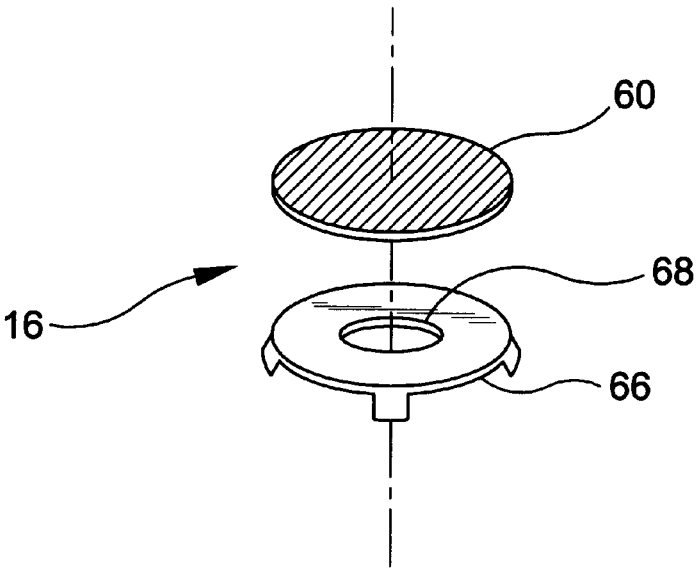
FIG. 8 is a exploded view of the label shown in FIG. 7.

Referring now to FIGS. 7, 8 and 9, a further embodiment of the wick change indicator 16 is a label 60 that is impregnated with a chemical that changes color as a function of humidity. As shown in FIG. 9, the label 60 has a first and second regions 62, 64. The first region 62 is light in color and darkens when the exit-relative humidity of the airflow reaches a first predetermined value. The second region 64 is also light in color and darkens when the exit-relative humidity of the airflow reaches a second predetermined value. Either the first region 62 or the second region 64 define a set of indicia to form the display indicating the wick 14 requires replacement. Preferably the first predetermined value is approximately 87 percent and the second predetermined value is approximately 60 percent. As shown in FIG. 8, the label 60 can be provided with a support plate 66 for attaching the label to the upper portion 22 of the housing 12. The support plate 66 is formed with an opening 68 through its center to insure that the label makes contact with the exiting airflow. The label 60 can be mounted in the position shown in FIG. 1 for the wick change indicator 16. Preferably the label 60 is mounted in the center of the air outlet 30 as shown in FIG. 7. In an alternative embodiment, the second region is dark in color. In this embodiment the label 60 will indicate that the wick should be replaced when the humidifier 10 is turned off. If the wick 14 is good and the humidifier 10 is turned on, the indication to replace the wick 14 will then disappear.

Figure 11:
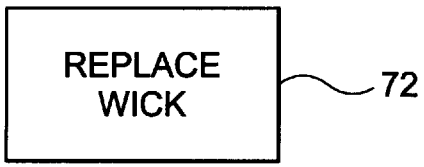
FIG. 11 is a plan view of a liquid crystal display that is used in conjunction with the electrical hygrometer shown in FIG. 10.
Figure 10:
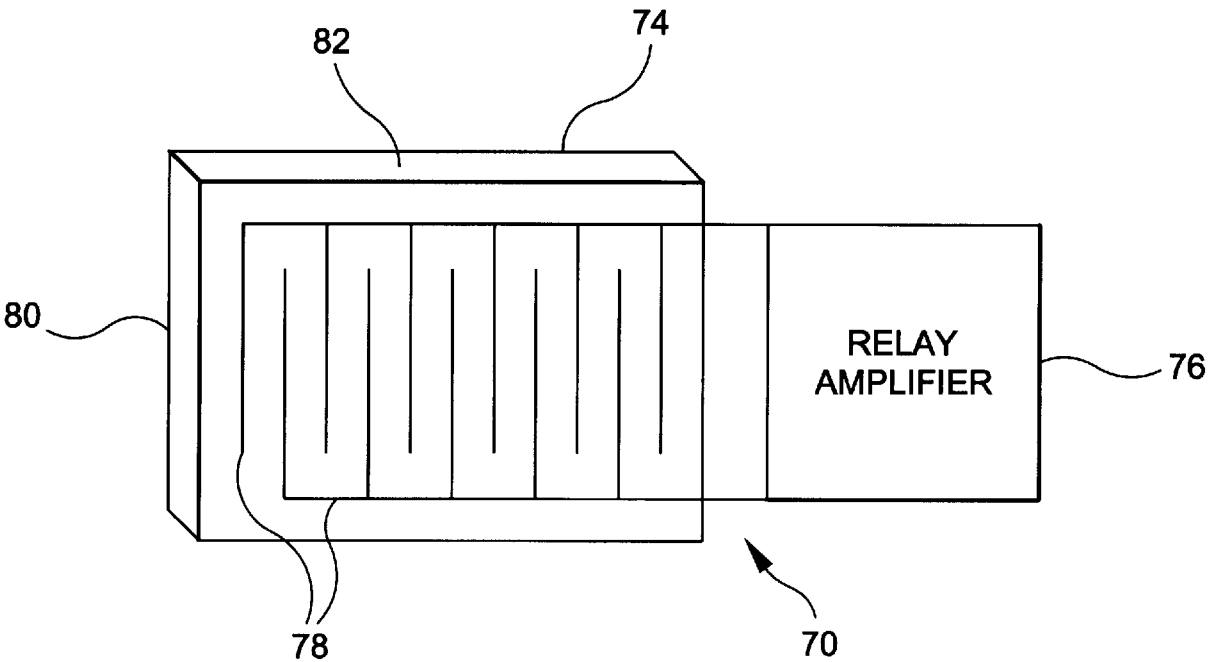
FIG. 10 is a perspective view of an electrical hygrometer formed in accordance with the present invention with an attribute shown schematically.

Referring now to FIGS. 10 and 11, a preferred embodiment of the wick change indicator 16 includes an electrical hygrometer 70 and a liquid crystal display 72. The electrical hygrometer 70 includes a sensing element 74 and a relay amplifier 76. The sensing element 74 has alternate metal conductors 78 on small flat plate 80 with a plastic coating 82. The electrical hygrometer 70 is mounted to the housing 12 within the exiting airflow. The electrical hygrometer 70 is connected to the liquid crystal display 72 and is calibrated to have the display 72 indicate that the wick requires replacement when the exit-relative humidity of the airflow falls below a predetermined humidity.

In the preferred embodiments described with reference to FIGS. 1 through 10, the wick change indicator 16 included only one hygrometer to measure the exit-relative humidity of the airflow generated by the fan 15. In alternative embodiments of the invention, described below the wick change indictor 16 includes a second hygrometer for measuring the ambient-relative humidity, and means for comparing the exit-relative humidity with the ambient-relative humidity for indicating when the wick 14 requires replacement.

Figure 12:
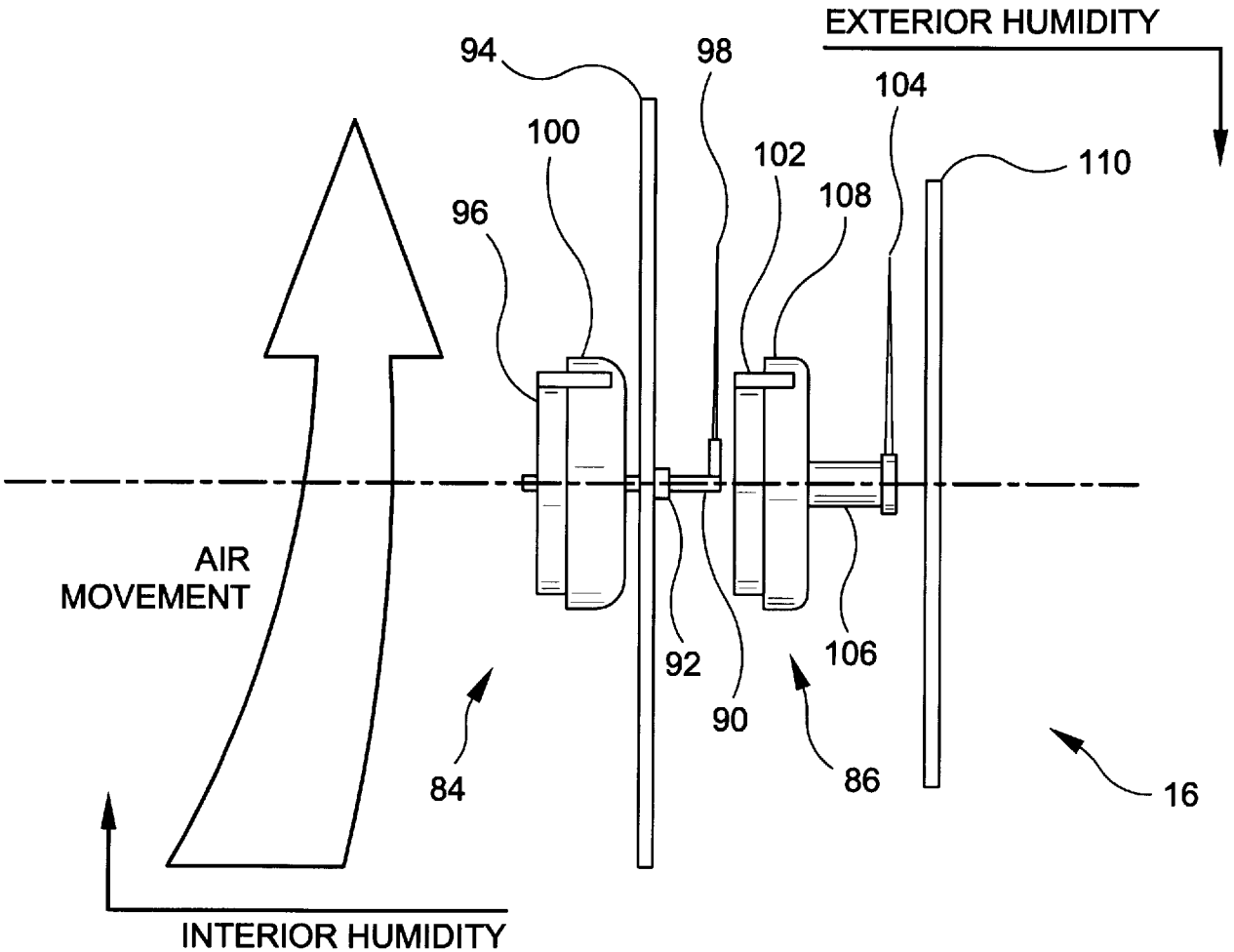
FIG. 12 is a partial cross-sectional view through the upper portion of the housing illustrating an alternative embodiment of the present invention that has a second hygrometer.

Referring now to FIG. 12, a preferred embodiment of a wick change indicator 16 includes first and second hygrometers 84, 86 for forming a display 88 in accordance with the present invention. The first hygrometer 84 is located within the humidifier 10 to measure the exit-relative humidity whereas the second hygrometer 86 is positioned on the exterior of the humidifier 10 to measure the ambient-relative humidity. Both the first and second hygrometers 84, 86 share a shaft 90 that extends through a bearing 92, which is supported by a support plate 94. The support plate 94 can be a separate part that is configured to attach to the housing 12 or it can be integrally formed as part of the housing 12. The first hygrometer 84 has a first humidity sensitive element 96 and a first indicating needle 98 coupled by the shaft 90. Where the first humidity sensitive element 96 is a metallic coil similar to that shown in FIG. 3, a first holder 100 is preferably provided to restrain the free end of the coil. The second hygrometer 86 has a second humidity sensitive element 102 and a second indicating needle 104 coupled by a sleeve 106 that rides the shaft 90 so that both the shaft 90 and sleeve 106 can rotate independently of each other. Similarly where the second humidity sensitive element 96 is a metallic coil, a second holder 108 is preferably provided to restrain the other end of the coil. The first indicating needle 98 and the second indicating needle 104 form the display 88 for providing an indication that the wick 14 requires replacement. Preferably the wick change indicator 16 is provided with a window 110 for protection.

Figure 14:
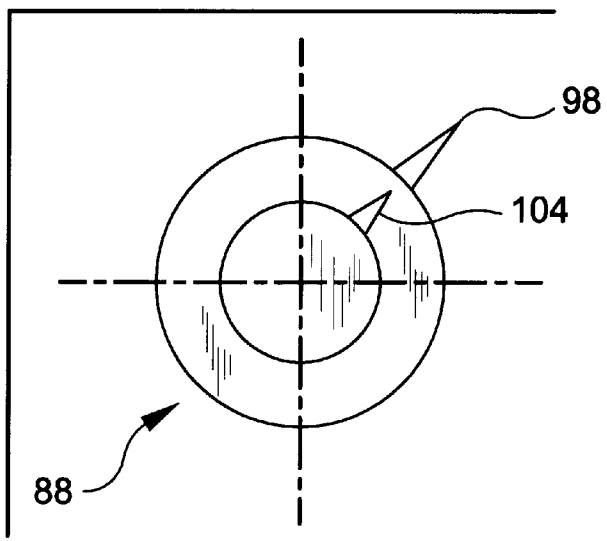
FIG. 14 is a view of the display of the embodiment of the invention shown in FIG. 12 when the humidifier is off and the ambient-relative humidity is high.
Figure 13:
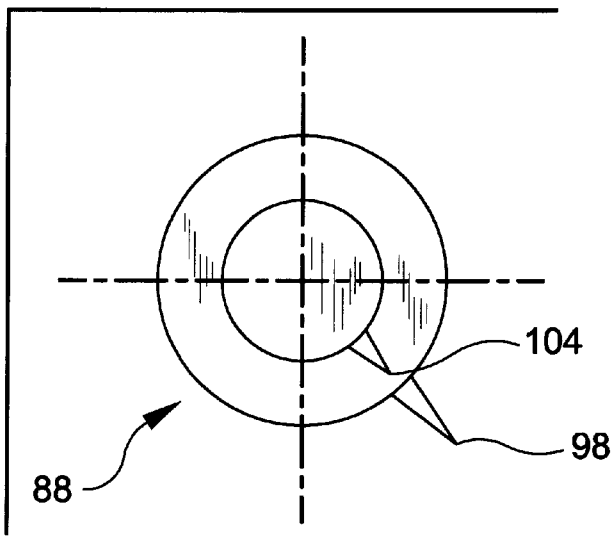
FIG. 13 is a view of the display of the embodiment of the invention shown in FIG. 12 when the humidifier is off and the ambient-relative humidity is low.
Figure 16:
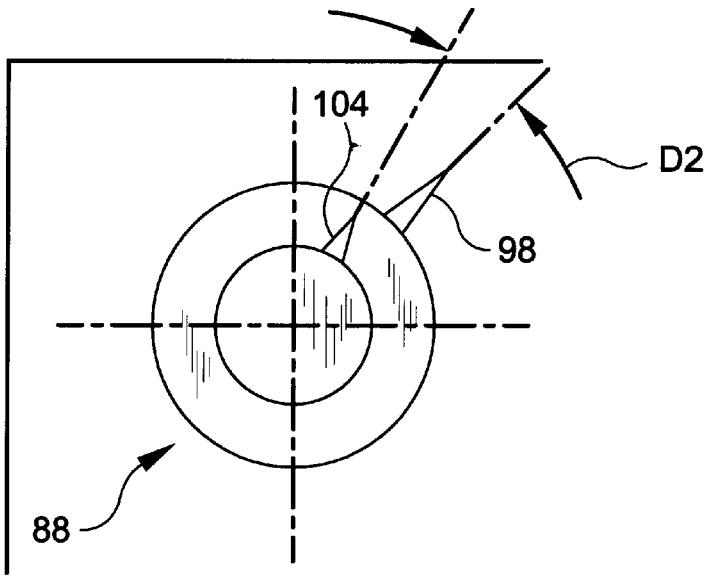
FIG. 16 is a view of the display of the embodiment of the invention shown in FIG. 12 when the humidifier is on, the ambient-relative humidity is high, and the wick is good.
Figure 15:
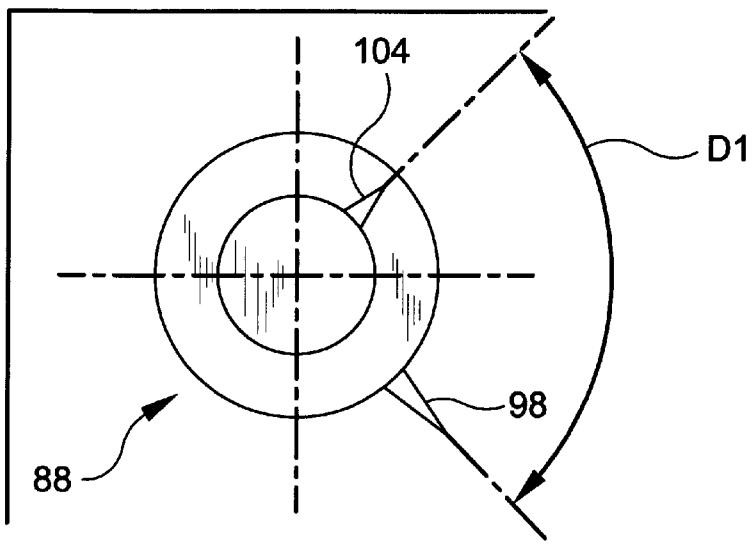
FIG. 15 is a view of the display of the embodiment of the invention shown in FIG. 12 when the humidifier is on, the ambient-relative humidity is low, and the wick is good.
Figure 17:
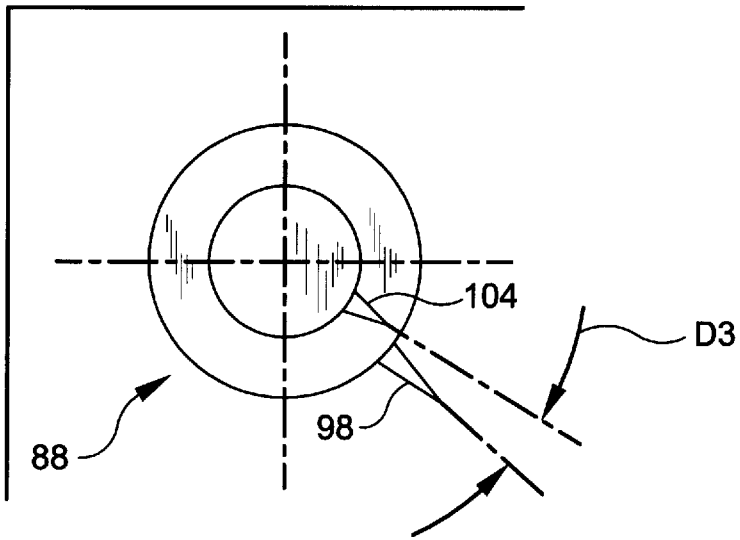
FIG. 17 is a view of the display of the embodiment of the invention shown in FIG. 12 when the humidifier is on, the ambient-relative humidity is low, and the wick is bad.

Referring now to FIGS. 13 through 18, the operation of the wick change indicator 16 shown in FIG. 12 will be explained. When the unit is off and not working, the humidity inside the humidifier will be substantially identical to the ambient-relative humidity outside of the humidifier. Thus both the first and second hygrometers 84, 86 would indicate the same reading whether the ambient-relative humidity is low or high as shown in FIGS. 13 and 14 respectively. However, when the ambient-relative humidity is low, a good wick 14 installed in the humidifier 10, and the humidifier 10 is turned on, there is a large difference, D1, between the ambient-relative humidity and the exit-relative humidity values as shown in FIG. 15. This is because a good wick will be saturated with water and create a high exit-relative humidity value. This difference is thus a measure of the wick 14 condition. A large difference between the first and second hygrometers 84, 86 indicates that the wick 14 is good and functioning well. Similarly a small difference generally indicates that the wick 14 is bad and needs to be replaced as shown in FIG. 17.

Figure 18:
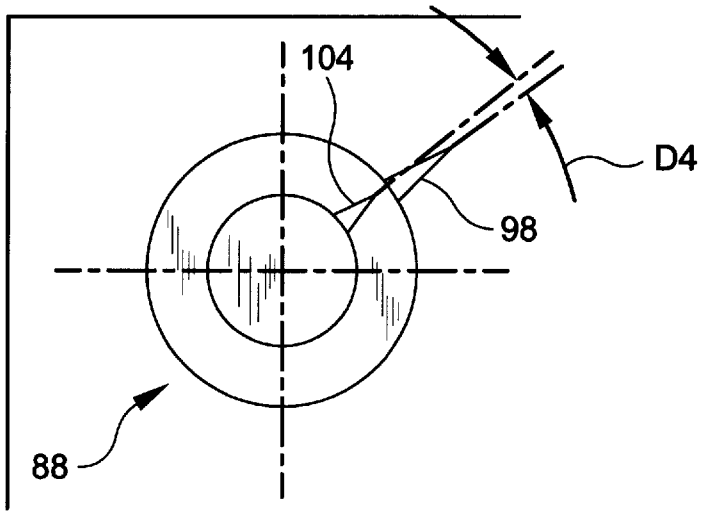
FIG. 18 is a view of the display of the embodiment of the invention shown in FIG. 12 when the humidifier is on, the ambient-relative humidity is high, and the wick is bad.

Referring now to FIGS. 16 and 18, when the ambient-relative humidity is already high, it is difficult to determine whether the wick 14 needs to be replaced. This is due to the fact that the efficiency of the humidifier 10 decreases exponentially as a function of the ambient-relative humidity. Thus, a dry room will be easier to humidify than a humid room. Thus the wick change indicator 16, at this condition cannot tell the difference between a good or a bad wick. This problem can be overcome through use of appropriate user instructions.

Figure 19:
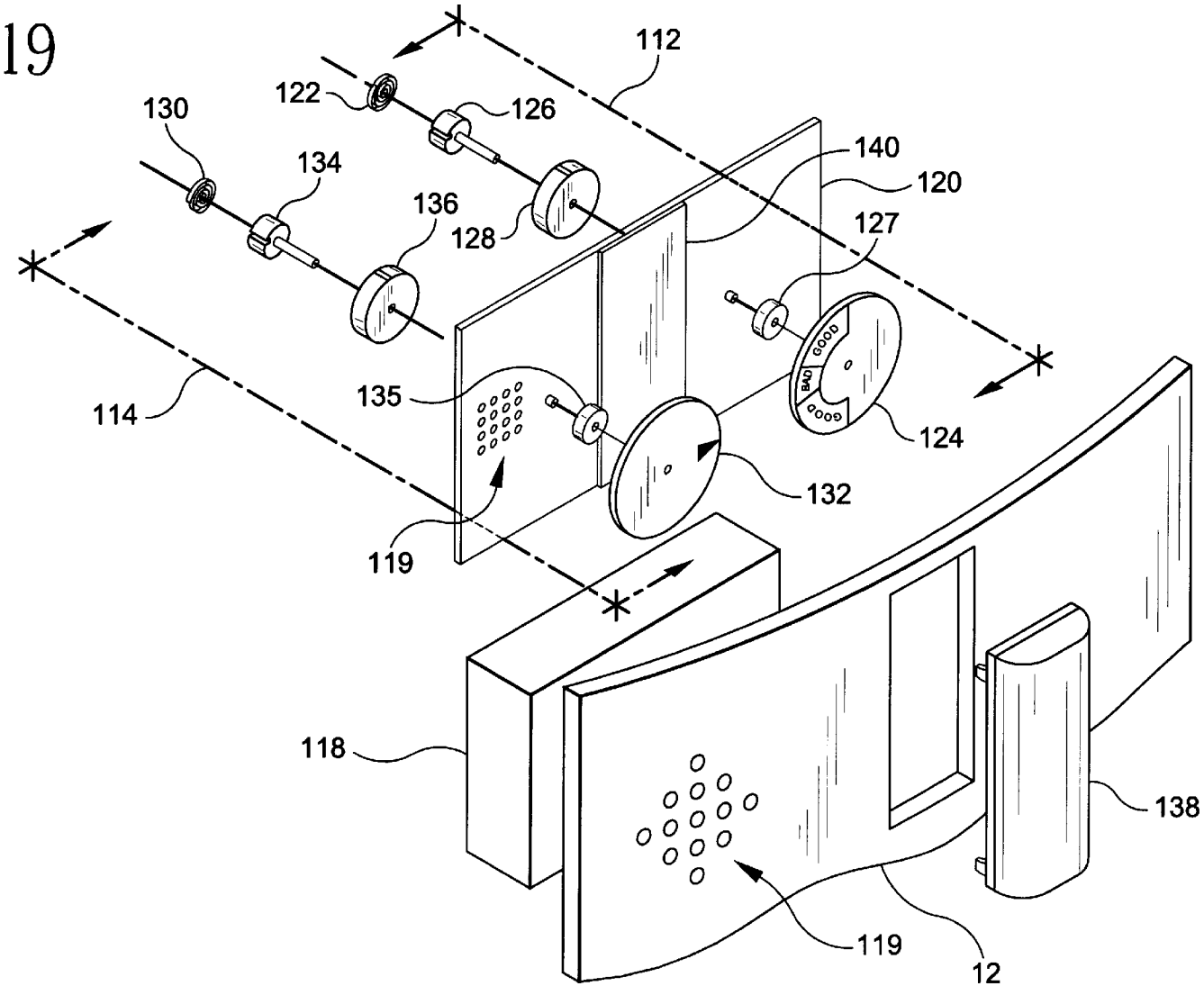
FIG. 19 is an exploded view of the upper portion of the housing illustrating an alternative embodiment of the present invention that has a second hygrometer.
Figure 27:
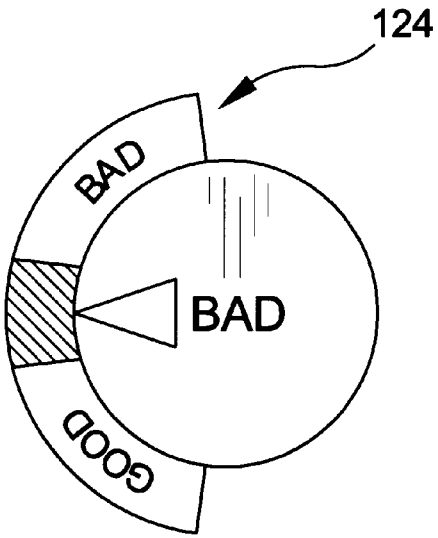
FIG. 27 illustrates the graphic details for the first indicating disk for forming the display of the embodiment of the invention shown in FIG. 19.
Figure 26:
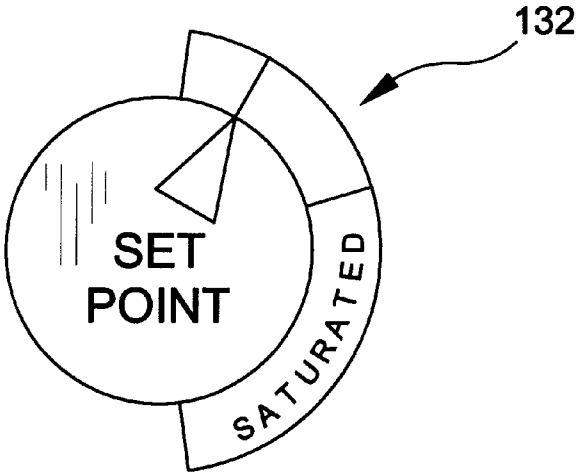
FIG. 26 illustrates the graphic details for the second indicating disk for forming the display of the embodiment of the invention shown in FIG. 19.

Referring now to FIG. 19, a preferred embodiment of a wick change indicator 16 includes first and second hygrometers 112, 114 adjacently arranged for forming a display 116 in accordance with the present invention. The first hygrometer 112 is located within the humidifier 10 to measure the exit-relative humidity. Preferably the second hygrometer 114 is also located within the humidifier 10, but is provided with an isolation housing 118 that includes openings 119 to measure the ambient-relative humidity. Preferably both the first and second hygrometers 112, 114 share a support plate 120 that can be either a separate part that is configured to attach to the housing 12 or it can be integrally formed as part of the housing 12. The first hygrometer 112 has a first humidity sensitive element 122 and a first indicating disk 124 coupled by a first shaft 126 that extends through a bearing 127, which is supported by the support plate 120. Where the first humidity sensitive element 122 is a metallic coil similar to that shown in FIG. 3, a first holder 128 is preferably provided to restrain the free end of the coil. The second hygrometer 114 has a second humidity sensitive element 130 and a second indicating disk 132 coupled by a second shaft 134 that extends through a bearing 135, which is supported by the support plate 120. Similarly where the second humidity sensitive element 122 is a metallic coil, a second holder 136 is preferably provided to restrain the free end of the coil. Further, when metallic coils are used for both the first humidity sensitive element 122 and the second humidity sensitive element 130, one of the coils is arranged in a clockwise manner with the other in a counter clockwise manner. Referring now to FIGS. 26 and 27, the first indicating disk 124 and the second indicating disk 132 are each provided with graphic details to form the display 116 to provide an indication that the wick 14 requires replacement. Preferably the wick change indicator 16 is provided with a window 138 for protection and a reflective background 140.

Figure 21:
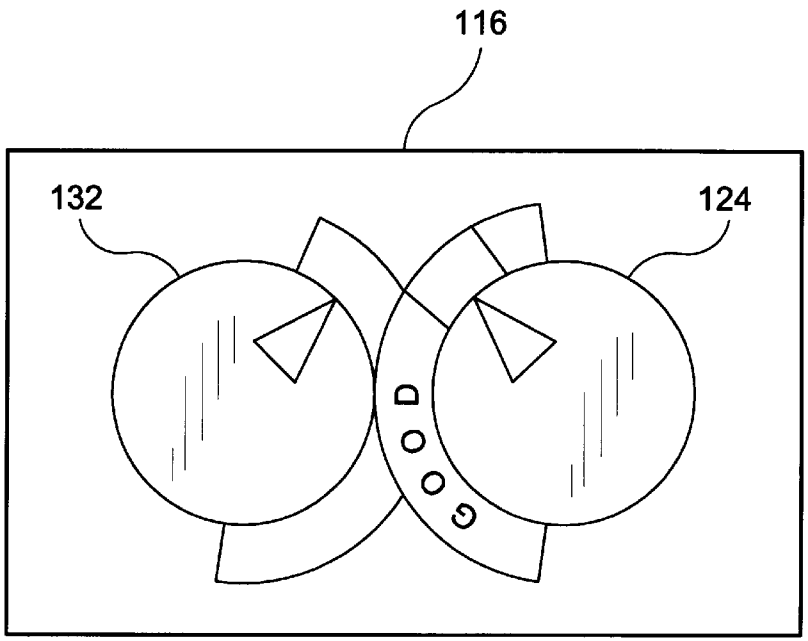
FIG. 21 is a view of the display of the embodiment of the invention shown in FIG. 19 when the humidifier is off and the ambient-relative humidity is high.
Figure 20:
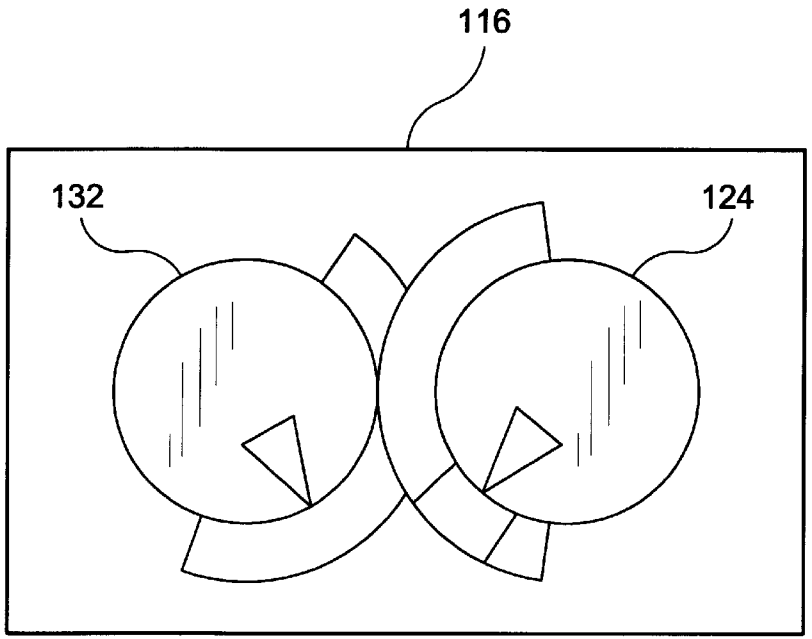
FIG. 20 is a view of the display of the embodiment of the invention shown in FIG. 19 when the humidifier is off and the ambient-relative humidity is low.
Figure 23:
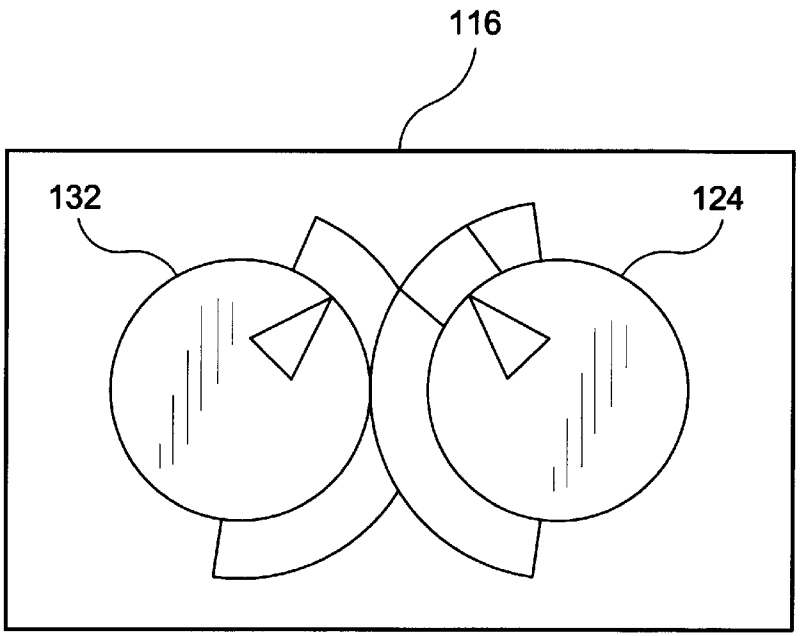
FIG. 23 is a view of the display of the embodiment of the invention shown in FIG. 19 when the humidifier is on, the ambient-relative humidity is high, and the wick is good.
Figure 22:
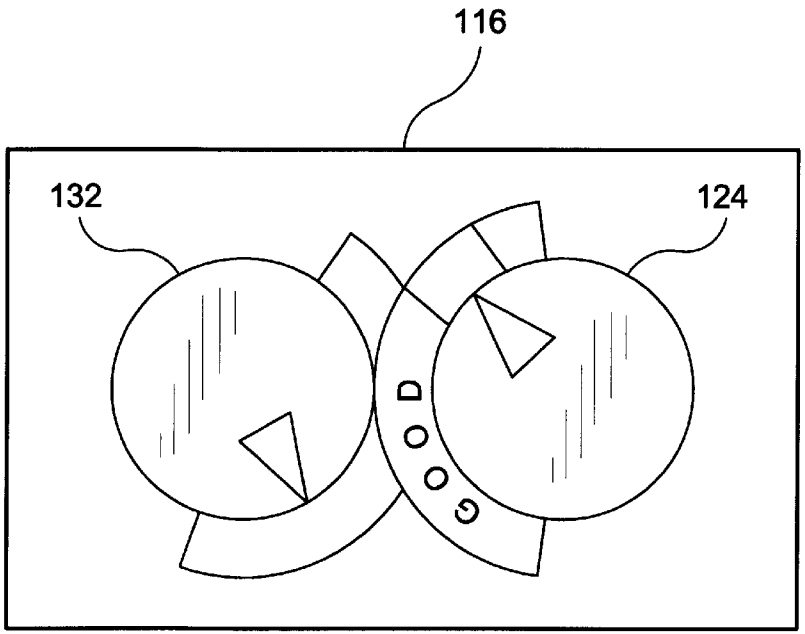
FIG. 22 is a view of the display of the embodiment of the invention shown in FIG. 19 when the humidifier is on, the ambient-relative humidity is low, and the wick is good.
Figure 24:
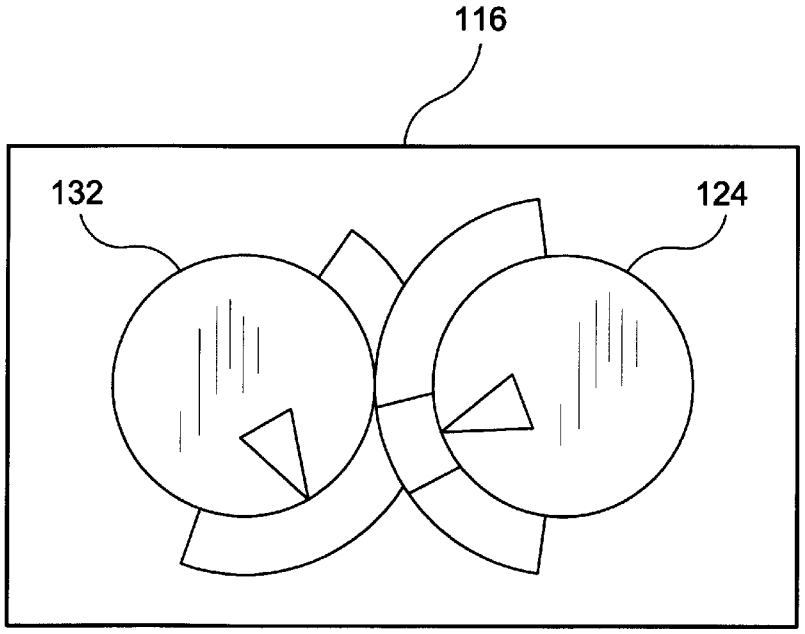
FIG. 24 is a view of the display of the embodiment of the invention shown in FIG. 19 when the humidifier is on, the ambient-relative humidity is low, and the wick is bad.

Referring now to FIGS. 20 through 25, the operation of the wick change indicator 16 shown in FIG. 19 will be explained. When the unit is off and not working, the humidity inside the humidifier will be substantially identical to the ambient-relative humidity outside of the humidifier 10. Thus both the first and second hygrometers 112, 114 would indicate the same reading whether the ambient-relative humidity is low or high as shown in FIGS. 20 and 21 respectively. However, when the ambient-relative humidity is low, a good wick 14 installed in the humidifier 10, and the humidifier 10 is turned on, there is a large difference between the ambient-relative humidity and the exit-relative humidity values as shown in FIG. 22. This is because a good wick will be saturated with water and create a high exit-relative humidity value. This difference is thus a measure of the wick 14 condition. A large difference between the first and second hygrometers 112, 114 indicates that the wick 14 is good and functioning well. Similarly a small difference generally indicates that the wick 14 is bad and needs to be replaced as shown in FIG. 24.

Figure 25:
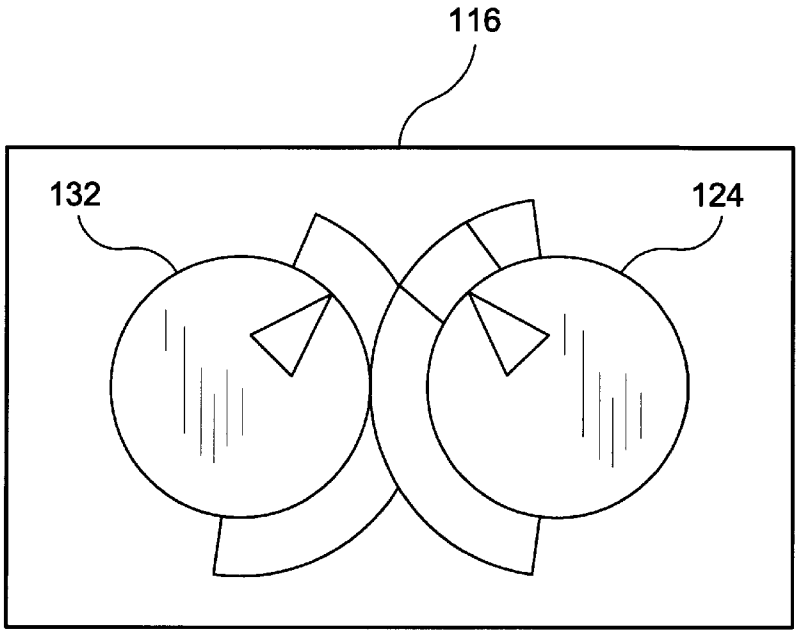
FIG. 25 is a view of the display of the embodiment of the invention shown in FIG. 19 when the humidifier is on, the ambient-relative humidity is high, and the wick is bad.

Referring now to FIGS. 23 and 25, when the ambient-relative humidity is already high, it is difficult to determine whether the wick 14 needs to be replaced for the same reasons described above with regard to the embodiment depicted in FIG. 12. Again this problem can be overcome through use of appropriate user instructions.

Figure 28:
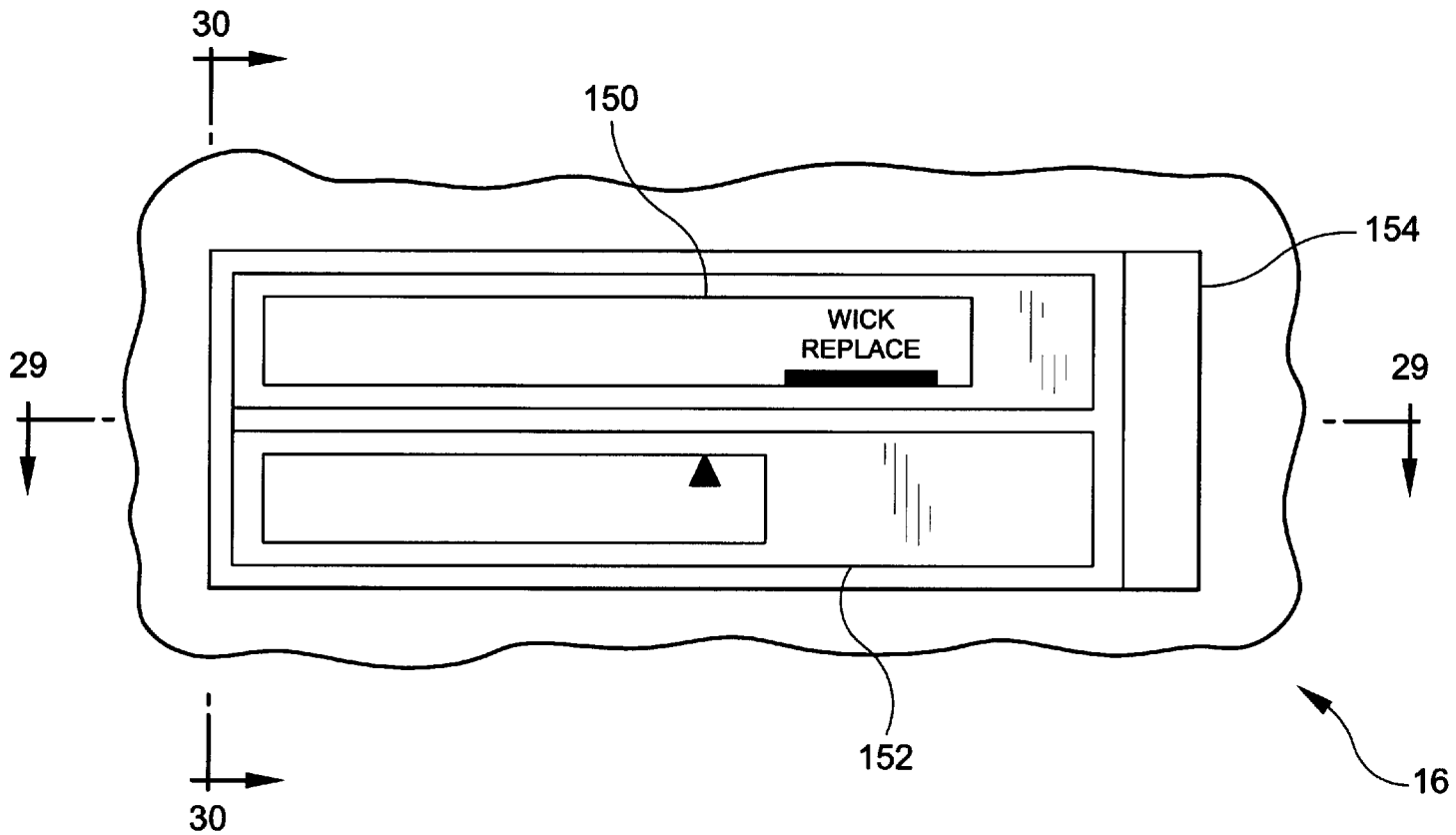
FIG. 28 is a view of a display of an alternative embodiment of the present invention that has a second hygrometer.
Figure 29:
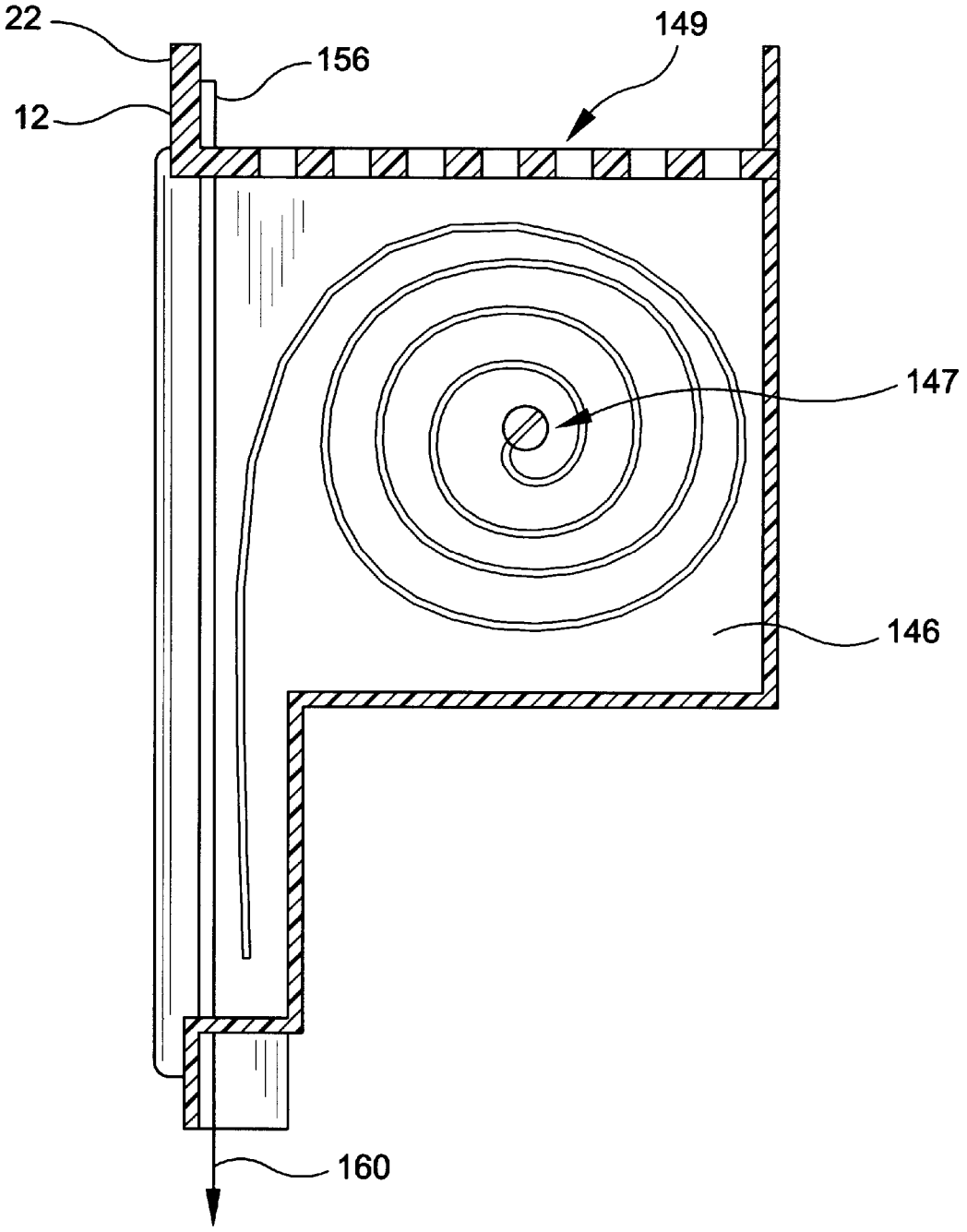
FIG. 29 is a cross-sectional view through the embodiment of the invention shown in FIG. 28.
Figure 31:
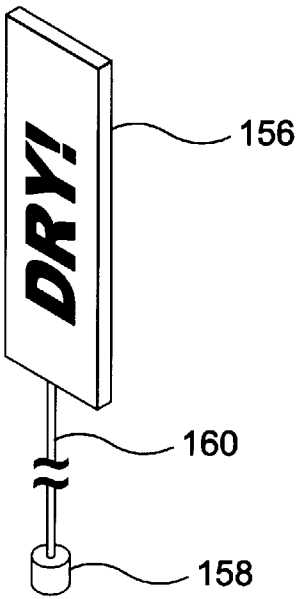
FIG. 31 is an isolated view of the shade configuration.
Figure 30:
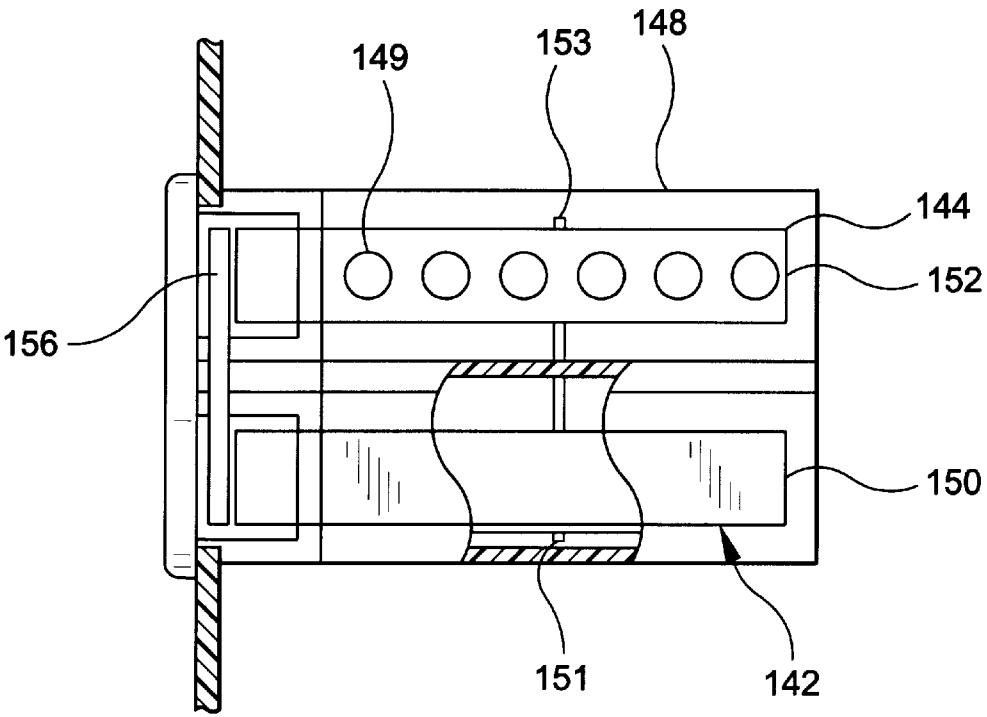
FIG. 30 is a partial cross-sectional view through the embodiment of the invention shown in FIG. 28.
Figure 32:
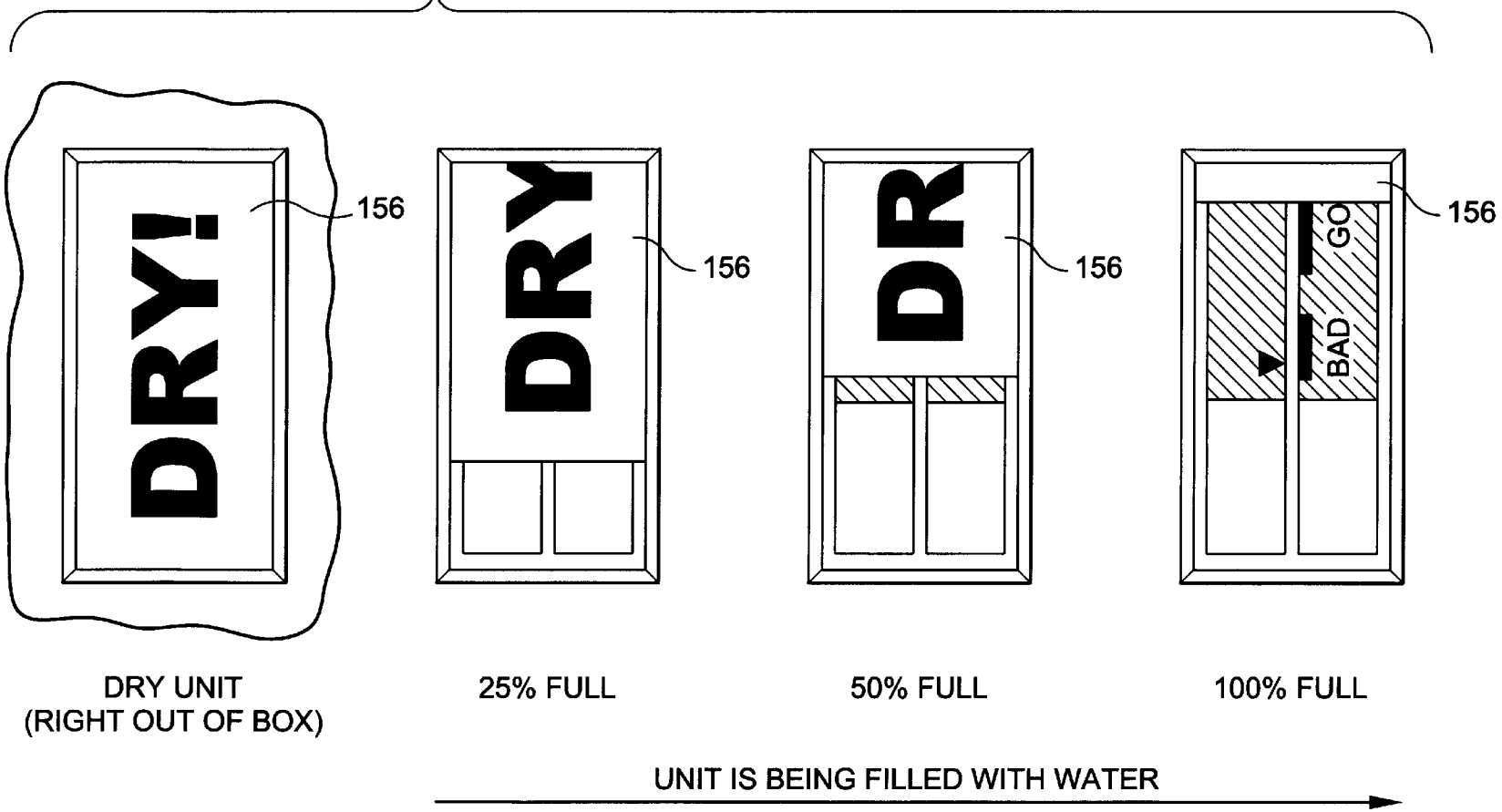
FIG. 32 is a view illustrating the operation of the shade at various reservoir levels.

Referring now to FIGS. 28, 29, and 30, another embodiment of a wick change indicator 16 includes first and second hygrometers 142, 144 adjacently arranged for forming a display 154 in accordance with the present invention. Both the first and second hygrometers 142, 144 share a support plate 146 and a fixed shaft 147. The fixed shaft 147 extends through the support plate 146 having a first end 151 and a second end 153 extending from opposite sides of the support plate. The first hygrometer 142 is located within the humidifier 10 to measure the exit-relative humidity. Preferably the second hygrometer 144 is also located within the humidifier 10, but is provided with an isolation housing 148 that includes openings 149 to allow the second hygrometer 144 to measure the ambient-relative humidity. The first hygrometer 142 has a first humidity sensitive element 150 that is attached to the first end 151 of the fixed shaft 147. Similarly the second hygrometer 144 has a second humidity sensitive element 152 that is attached to the second end 153 of the fixed shaft 147. Preferably the first and second humidity sensitive elements 150, 152 are metallic coils provided with graphic details at their free ends to form a display 154 as shown in FIG. 28. Preferably the wick change indicator 16 also includes a shade 156 that is attached to a float 158 through a link 160 to provide an indication as to whether there is water in the reservoir 28 of the humidifier 10. When the humidifier is completely dry, the float 158 and the shade 156 will be fully seated. As the reservoir is filled with water the float 158 lifts the shade 156 as shown in FIG. 32.

Figures 33, 34, 35, 36:
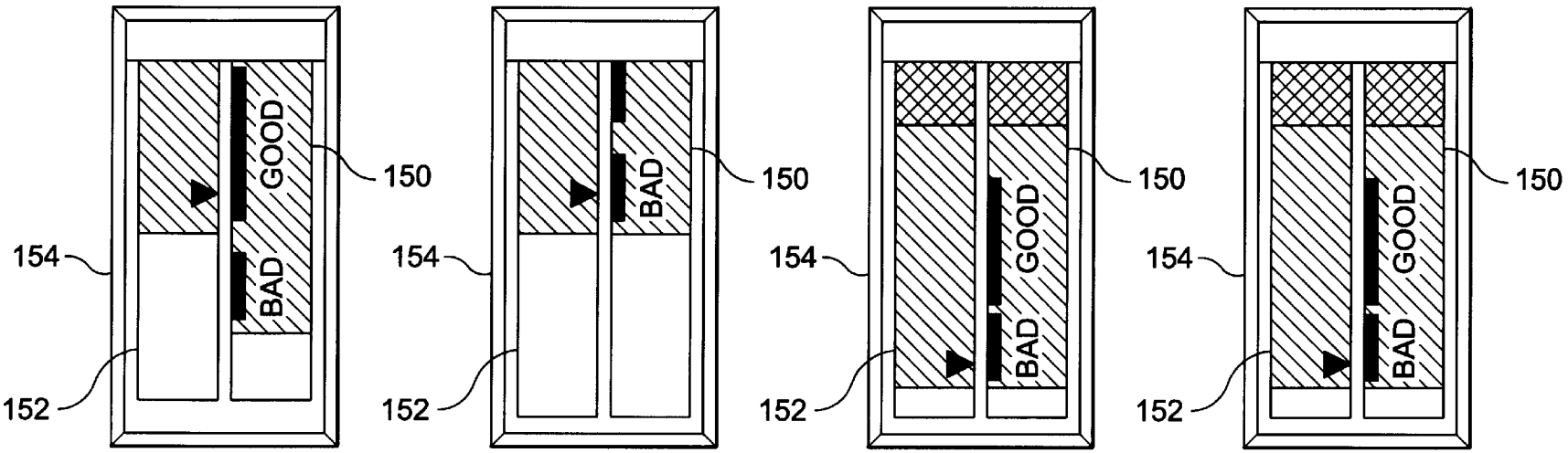
FIG. 33 is a view of the display of the embodiment of the invention shown in FIG. 28 when the humidifier is on, the ambient-relative humidity is low, and the wick is good.
FIG. 34 is a view of the display of the embodiment of the invention shown in FIG. 28 when the humidifier is on, the ambient-relative humidity is low, and the wick is bad.
FIG. 35 is a view of the display of the embodiment of the invention shown in FIG. 28 when the humidifier is on, the ambient-relative humidity is high, and the wick is good.
FIG. 36 is a view of the display of the embodiment of the invention shown in FIG. 28 when the humidifier is on, the ambient-relative humidity is high, and the wick is bad.

Referring now to FIGS. 33 through 36, the operation of the wick change indicator 16 shown in FIGS. 28 through 30 will be explained. When the ambient-relative humidity is low, a good wick 14 installed in the humidifier 10, and the humidifier 10 is turned on, there is a difference between the ambient-relative humidity and the exit-relative humidity values as shown in FIG. 33 which provides an indication that the wick is good. However, when the ambient-relative humidity is low, a bad wick 14 is installed in the humidifier 10, and the humidifier 10 is turned on, there is generally only a small difference between the ambient-relative humidity and the exit-relative humidity values as shown in FIG. 34 which provides an indication that the wick is bad.

Referring now to FIGS. 35 and 36, when the ambient-relative humidity is already high, it is difficult to determine whether the wick 14 needs to be replaced for the same reasons described above with regard to the embodiment depicted in FIG. 12. Again this problem can be overcome through use of appropriate user instructions.

Although illustrative embodiments of the present invention have been described herein with reference to the accompanying drawings, it is to be understood that the invention is not limited to those precise embodiments, and that various other changes and modifications may be effected by one skilled in the art without departing from the scope or spirit of the invention.

What is claimed is:

1. A humidifier for providing moisture into an airflow to humidify air in a room having an ambient-relative humidity, the humidifier comprising:

a housing having an air inlet, an air outlet, and a reservoir for holding water;

a wick which is seated in the reservoir;

a fan provided within the housing for creating the airflow, the airflow entering the air inlet, passing through the wick for adding moisture to the air and exiting through the air outlet into the room, the exiting air having an exit-relative humidity associated therewith; and a wick change indicator which includes:

a hygrometer positioned within the airflow for measuring the exit-relative humidity of the airflow; and a display coupled to the hygrometer for indicating when the wick requires replacement based upon the measured exit-relative humidity reaching a predetermined value.

2. A humidifier as defined in claim 1, wherein said predetermined value is approximately 87 percent.

3. A humidifier as defined in claim 1, wherein said hygrometer comprises a humidity sensitive element and an indicating needle coupled to said humidity sensitive element for providing a visual display that said wick requires replacement.

4. A humidifier as defined in claim 1, wherein said display includes indicia to provide visual indication that said reservoir is empty.

5. A humidifier as defined in claim 1, wherein the display includes indicia to provide visual indication that the humidifier is off.

6. A humidifier as defined in claim 3, wherein said humidity sensitive element is a metallic coil.

7. A humidifier as defined in claim 3, wherein said hygrometer further comprises a support plate with said display formed thereon and wherein said display has markings such that said needle is positioned with respect to said markings to provide an indication that said wick needs replacement.

8. A humidifier as defined in claim 6, wherein said metallic coil has a tapered width that decreases from a central end to an external end of said coil.

9. A humidifier as defined in claim 1, wherein said hygrometer includes:

a label that is impregnated with a chemical that changes color as a function of humidity, said label having:

a first region that is light in color and darkens when the exit-relative humidity of the airflow reaches a first predetermined value; and a second region that is light in color and darkens when the exit-relative humidity of the airflow reaches a second predetermined value, wherein one of said first region and said second region define a set of indicia to form said display.

10. A humidifier as defined in claim 9, wherein said first predetermined value is approximately 87 percent and said second predetermined value is approximately 60 percent.

11. A humidifier as defined in claim 1, wherein said hygrometer is an electrical type and said display is a liquid crystal type mounted to the housing and is calibrated to indicate that the wick requires replacement when the exit-relative humidity of the airflow falls below a predetermined humidity.

12. A humidifier as defined in claim 1, further comprising a second hygrometer to measure the ambient-relative humidity and including a means for comparing said exit-relative humidity with said ambient-relative humidity for indicating when the wick requires replacement.

13. A room humidifier comprising:

a housing having an air inlet, an air outlet, and a reservoir for holding water a wick element in fluid communication with said water;

a fan positioned within said housing for creating an airflow, the airflow entering said housing through said inlet, passing through said wick element to add moisture thereto and exiting through said outlet, said exiting air having a relative humidity associated therewith; and a hygrometer positioned within the exiting airflow for measuring the relative humidity of the exiting airflow, said hygrometer being calibrated to provide visual indication that said wick requires replacement.

14. A room humidifier as defined in claim 13, wherein said hygrometer provides visual indication that said wick requires replacement when the relative humidity of the exiting airflow reaches a predetermined value.

15. A room humidifier as defined in claim 13, wherein said hygrometer comprises a humidity sensitive element and an indicating needle coupled to said humidity sensitive element.

16. A room humidifier as defined in claim 15, wherein said humidity sensitive element is a metallic coil.

17. A room humidifier as defined in claim 16, wherein said metallic coil has a tapered width that decreases from a central end to an external end of said coil.

18. A room humidifier as defined in claim 13, wherein said hygrometer includes:

a label that is impregnated with a chemical that changes color as a function of humidity, said label having:

a first region that is light in color and darkens when the relative humidity of the exiting airflow reaches a predetermined value; and a second region that is dark in color, wherein one of said first region and said second region define a set of indicia for indicating when the wick requires replacement based upon the relative humidity of the exiting airflow reaching a predetermined value.

19. A room humidifier as defined in claim 18, wherein said predetermined value is approximately 87 percent.

20. A room humidifier as defined in claim 13, further comprising a second hygrometer to measure the ambient-relative humidity and including a means for comparing said exit-relative humidity with said ambient-relative humidity for indicating when the wick requires replacement.

21. A method of monitoring a performance of a wick in a room humidifier to determine replacement, the humidifier including a housing with an inlet, an outlet, and a reservoir for holding water, the wick being seated in the reservoir, and a fan for creating an airflow with an exit-relative humidity, the airflow entering the inlet, passing through the wick and exiting through the outlet, said method comprising the steps of:

(a) measuring the exit-relative humidity of the airflow as the airflow exits through the outlet of the housing; and (b) providing an indication that the wick requires replacement when the exit-relative humidity falls below a predetermined value.

22. A method of maintaining the performance of a room humidifier including a reservoir, a wick extending into the reservoir, a fan for creating an airflow through the wick, a hygrometer for measuring a humidity level of the airflow exiting the wick, and an indicator for indicating when the humidity level in the airflow exiting the wick drops below a predetermined value, comprising:

operating the humidifier such that the wick draws water from the reservoir and the fan causes air to flow through the wick, and replacing the wick when the indicator indicates that the humidity level has dropped below the predetermined value.

23. A method as described in claim 22, including the step of providing an indicator signal from the indicator advising a user to replace the wick when the humidity level has dropped below the predetermined value.

24. A method as described in claim 22, including the step of indicating to a user that a drop in the humidity level below the predetermined value may be due to conditions other than poor wick performance.

25. A method as described in claim 22, including comparing the humidity level measured by said hygrometer with a second humidity level measured by a second hygrometer, and replacing the wick when the difference between said humidity levels is less than a preselected amount.

26. A room humidifier comprising:

a housing having an air inlet, an air outlet, and a reservoir for holding water a wick element in fluid communication with said water;

a fan positioned within said housing for creating an airflow, the airflow entering said housing through said inlet, passing through said wick element to add moisture thereto and exiting through said outlet, said exiting air having a relative humidity associated therewith; and a hygrometer positioned within the exiting airflow for measuring the relative humidity of the exiting airflow, said hygrometer being calibrated to provide visual indication when said reservoir is empty.

27. An apparatus for humidifying the air in an environment and comprising:

an exhaust air stream;

a water reservoir having a first condition wherein water is contained therein and a second condition wherein said water is depleted, and adapted in said first condition for providing moisture to said air stream such that said air stream has a higher humidity level during said first condition and a lower humidity level during said second condition; and a humidity sensor positioned in said exhaust air stream to sense said higher and lower humidity levels and having an indicator, said indicator providing an indication of said humidity level to thereby indicate whether said water reservoir is in said first or second condition and alert a user when said reservoir needs refilling.

28. An apparatus for humidifying the air in an environment and comprising:

an exhaust air stream;

a water reservoir;

an evaporation element having a desirable condition wherein water is properly wicked from said water reservoir and an undesirable condition wherein water is not properly wicked from said water reservoir and adapted in said desirable condition for evaporation moisture to said air stream such that said air stream has a higher humidity level during said desirable condition and a lower humidity level during said undesirable condition; and a humidity sensor positioned in said exhaust air stream to sense said higher and lower humidity levels and having an indicator, said indicator providing an indication of said humidity level to thereby indicate whether said evaporation element is in said desirable or undesirable condition and alert a user when said evaporation element needs replacement.

* * * * *